United States Patent [19]

Suehiro et al.

[11] Patent Number: 5,045,124

[45] Date of Patent: Sep. 3, 1991

[54] PROCESS FOR PRODUCING COLD-ROLLED STRIP OR SHEET OF AUSTENITIC STAINLESS STEEL

[75] Inventors: Toshiyuki Suehiro, Hikari; Masanori Ueda, Kitakyushu; Shigeru Minamino; Osamu Ikegami, both of Hikari, all of Japan

[73] Assignee: Nippon Steel Corporation, Tokyo, Japan

[21] Appl. No.: 492,557

[22] Filed: Mar. 12, 1990

[30] Foreign Application Priority Data

Mar. 14, 1989 [JP] Japan ..... 1-59781

[51] Int. Cl.[5] ..... C21D 8/02

[52] U.S. Cl. ..... 148/2; 148/12 E

[58] Field of Search ..... 164/476, 477; 148/2, 148/3, 12 E; 29/527.7

[56] References Cited

FOREIGN PATENT DOCUMENTS 85148247 7/1985 Japan .

OTHER PUBLICATIONS

"Tetsu-to-Hagane", 1985, A197-A256.

"Tetsu-to-Hagane", 1985, A200-A203.

*Primary Examiner*—Deborah Yee

*Attorney, Agent, or Firm*—Kenyon & Kenyon

[57] ABSTRACT

A process for producing a cold-rolled strip or sheet of an austenitic stainless steel, comprising the steps of: casting a melt of an austenitic stainless steel into a cast strip in the form of a thin strip having a thickness of 10 mm or less by using a continuous caster in which a casting-mold wall is moved synchronously with the cast strip; cold-rolling the cast strip to form a cold-rolled strip; final annealing the cold-rolled strip; and skin-pass-rolling the annealed strip at an elongation of from 0.5 to 2.5%.

3 Claims, 1 Drawing Sheet

PROCESS FOR PRODUCING COLD-ROLLED STRIP OR SHEET OF AUSTENITIC STAINLESS STEEL

BACKGROUND OF THE INVENTION

1. Field of the Invention

The present invention relates to a process for producing a cold-rolled strip or sheet of an austenitic stainless steel by cold-rolling a cast strip having a thickness close to or slightly greater than that of a product strip or sheet, the cast strip being cast by a synchronous type continuous caster in which a cast strip and a casting mold wall are moved without a relative speed difference therebetween.

2. Description of the Related Art

The conventional process for producing a cold-rolled strip or sheet of a stainless steel by using a continuous casting method comprises: casting a melt of a stainless steel into a cast slab having a thickness of 100 mm or more, under a forced oscillation of the casting mold; subjecting the cast slab to a surface treatment or cleaning; heating the slab to a temperature of 1000° C. or higher, followed by a hot-rolling by a hot strip mill comprising rough-rolling stands and finish-rolling stands to form a having a thickness of several millimeters; annealing or not annealing the hot strip; descaling the hot strip; cold-rolling the hot strip followed by a final annealing; and skin-pass-rolling the annealed strip.

The conventional process has a problem in that a long and large line of hot-strip mills is required to hot-roll a cast slab having a thickness of 100 mm or more, and that a great amount of energy is consumed in heating and hot-rolling the cast slab.

To solve these problems, research has been carried out into the development of a process for producing a cast strip having a thickness equivalent or close to that of a hot strip. These processes include a synchronous type continuous casting, in which a cast strip and an inner wall of a casting mold are moved without a relative speed difference therebetween, such as a twin roll process or a twin belt process, as reported in "Tetsu-to-Hagane (Iron and Steel)", 1985, page A197-A256, for example.

Nevertheless, problems still arise when producing a cold-rolled strip or sheet product of a stainless steel by using such a synchronous type continuous casting process, in that a final product strip or sheet has a relatively poor surface appearance due to the reduction or omission of the steps of the process from a cast strip to the product.

The present inventors cast a melt of JIS SUS 304 stainless steel, a most widely used austenitic stainless steel, into a cast strip in the form of a thin strip, by using an inside water-cooled type twin-roll continuous caster, and cold-rolled the cast strip to form a cold-rolled strip or sheet which was then annealed and pickled to obtain a "2B" product strip or sheet (specified by JIS G4305) or bright-annealed to obtain a "BA" product strip or sheet (specified by JIS G4305). A study showed that the surface of a product sheet obtained by using a twin-roll type continuous caster exhibits a characteristic appearance of fine wrinkles or fine crepe-like undulation (hereinafter referred to as "roping") and a nonuniform luster or uneven gloss.

SUMMARY OF THE INVENTION

The object of the present invention is to provide a simple process for producing a cold-rolled strip or sheet of an austenitic stainless steel by cold-rolling a cast strip cast by a synchronous type continuous caster (in which a cast strip and an inner wall of a casting mold are moved without a relative speed difference therebetween) and having a thickness close to that of a product strip or sheet, without causing characteristic problems in the surface appearance such as roping or a nonuniform luster.

To achieve the above object according to the present invention, there is provided a process for producing a cold-rolled strip or sheet of an austenitic stainless steel, comprising the steps of:

casting a melt of an austenitic stainless steel into a cast strip in the form of a thin strip having a thickness of 10 mm or less by using a continuous caster in which a casting-mold wall is moved synchronously with the cast strip;

cold-rolling the cast strip to form a cold-rolled strip;

final-annealing the cold-rolled strip; and skin-pass-rolling the annealed strip at an elongation of from 0.5 to 2.5%.

If a cast strip is to be pickled for descaling prior to the cold-rolling, the strip is preferably cooled at a cooling rate of at least 10° C./sec in the temperature range of upon casting.

Prior to the descaling, a cast strip is more preferably annealed at a temperature of 1050° C. or higher and at a cooling rate of at least 10° C./sec. in the temperature range of from 900 to 550° C.

DESCRIPTION OF THE PREFERRED EMBODIMENTS

Figure 1:
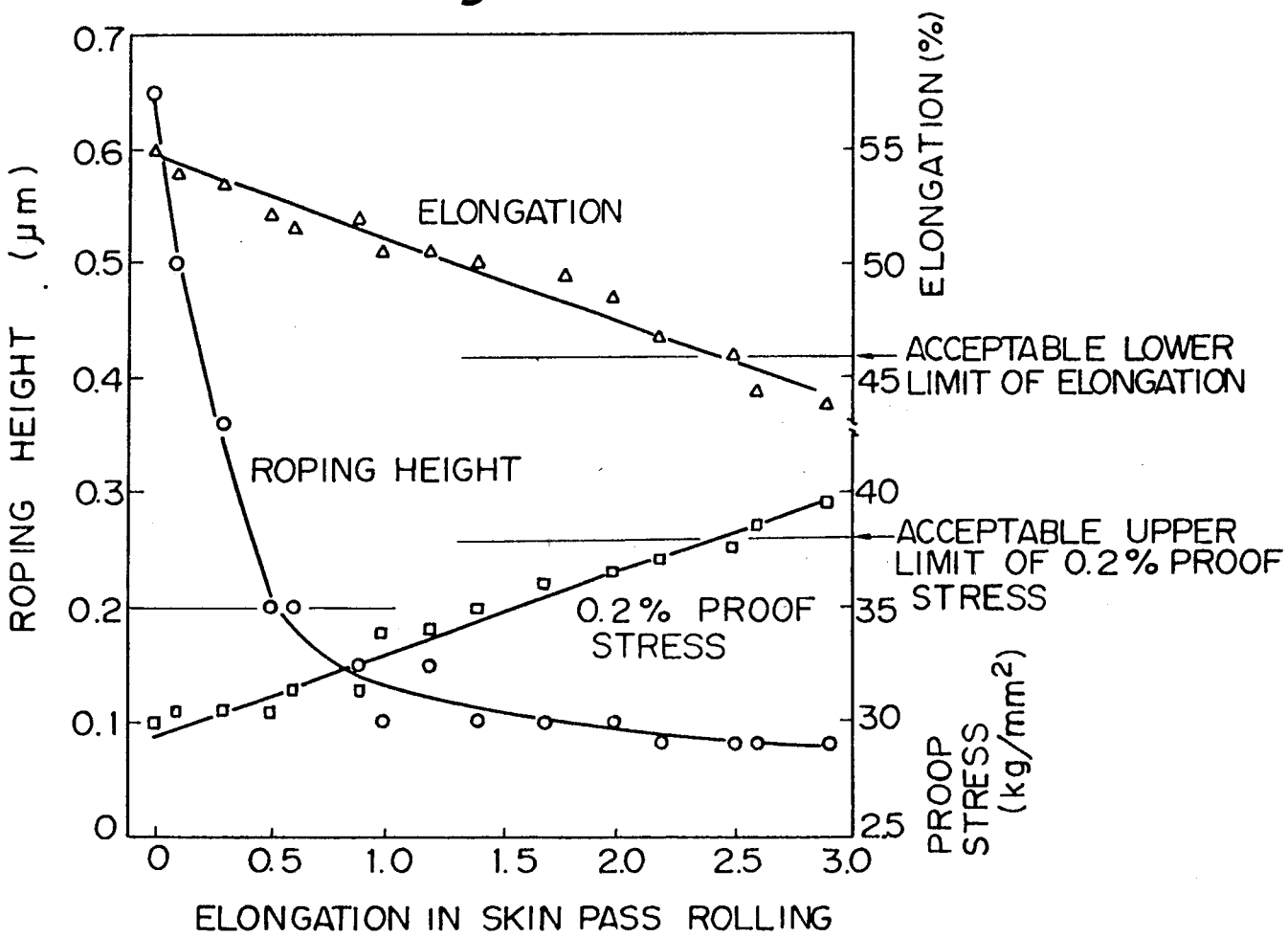
FIG. 1 is a graph showing the roping height and the mechanical property of a thin strip or sheet product as a function of the elongation during skin pass rolling.

In the present invention, continuous casters in which a casting mold wall is moved synchronously with a cast strip include those processes referred to as a single-roll process, a twin-roll process, an inner ring process, a roll-and-belt process, a twin-belt process, a moving mold process, and a spray-roll process, as reviewed in "Tetsu-to-Hagane (Iron and Steel)" 1985, pages A200 to A203.

The present inventors have found the cause of and developed a solution to the roping and nonuniform luster which occurs in strip or sheet products obtained by cold-rolling a cast strip of an austenitic stainless steel in the form of a thin strip cast by a twin-roll type continuous caster.

The roping occurs during cold-rolling when a material to be cold-rolled has a coarse $\gamma$-grain size, and therefore, may be prevented by adjusting the casting and/or cooling conditions for refining the $\gamma$-grain size, by cold-rolling using a hard roll or by adding particular elements to the steel, to refine the $\gamma$-grain size.

The present inventors, however, found an alternative solution to the conventional problem of the sheet appearance, i.e., roping and nonuniform luster, by a control of the skin-pass rolling, which is carried out after cold-rolling followed by a final annealing.

The present inventors also found that the nonuniform luster is caused when a grain-boundary corrosion occurs during pickling prior to cold-rolling, due to a chromium carbide precipitated in a cast strip surface having a nonuniform distribution of the grain size. The present inventors found that the nonuniform luster can be prevented if a cast strip is cooled at an appropriate cooling rate in the temperature region of the chromium carbide precipitation during cooling of a cast strip upon casting thereof or cooling after annealing.

The above-described causes of the roping and nonuniform luster, and the solutions thereto, can be generally applied to all synchronous types of continuous casting processes including a twin-roll type process, in which a casting mold and a cast strip are moved without a relative speed difference therebetween.

The limitations of the claimed process are based on the following.

If a cast strip in the form of a thin strip having a thickness more than 10 mm is cast by using a synchronous type continuous caster, the thus obtained cast strip, even when cooled at a high cooling rate during and after solidification, has a too coarse $\gamma$-grain size to enable an elimination of roping by a skin pass rolling. Therefore, the thickness of a cast strip must be limited to 10 mm or less. A cast strip preferably has a fine $\gamma$-grain, i.e., an average $\gamma$-grain size of 100 mm or less or a grain size No. 4 or greater (JIS G0551).

The cold-rolling of a cast strip to a product strip or sheet may be carried out with or without an intermediate annealing, and may be carried out in a temperature range in which no coloring due to oxidation occurs and may be a warm rolling.

After the cold-rolling to a product thickness is completed, a final annealing is carried out. When the final annealing is effected in an oxidizing atmosphere, an annealed strip is descaled and then skin-pass-rolled to obtain a JIS "2B" product strip or sheet. When the final-texture annealing is effected in a non-oxidizing atmosphere, i.e., a bright annealing, an annealed strip is not descaled but directly cold-rolled to obtain a JIS "BA" product strip or sheet.

The skin pass rolling according to the present invention must be effected at an elongation within the range of from 0.5 to 2.5%. The reason for this limitation is explained by FIG. 1, showing the roping height and the mechanical property of the product strip or sheet as a function of the elongation in skin pass rolling for the SUS 304 stainless steel strip or sheet samples obtained by casting a melt into a 3.3 mm thick cast strip, using an internally water-cooled, twin-roll type continuous caster, cold-rolling the cast strip at various rolling reductions of from 50 to 85%, and annealing the cold-rolled strip at 1100° C. for 30 sec. The result shows that the wave height or roping height of 0.6 to 0.7 $\mu$m before the skin pass rolling, was completely eliminated by a skin pass rolling effected at an elongation of 0.5% or more. A roping having a height not exceeding 0.2 $\mu$m causes no problem for a product strip or sheet and is considered to be a "no roping" state.

In the conventional process for producing a cold-rolled strip or sheet of an austenitic stainless steel, the skin pass rolling was carried out at an elongation of less than 0.5%. Although an increase of the elongation in a skin pass rolling causes an increase of the 0.2%-proof stress and a decrease of the elongation of a product strip or sheet, an elongation in a skin pass rolling not exceeding 2.5% causes no problems as a product sheet, i.e., practically required mechanical properties can be ensured.

The present inventors have ascertained that the above-described conclusion also can be applied to austenitic stainless steels other than SUS 304, i.e., an elongation in a skin pass rolling within the range of from 0.5 to 2.5% eliminates roping without causing problems with the mechanical properties.

The present invention also provides an additional effect in that an earing occurring during a deep drawing is suppressed in comparison with a conventional product strip or sheet obtained through hot-rolling, because the present invention does not use a hot-rolling, and therefore, the total rolling reduction amounts less than that of the conventional process, with the result that the development of a rolled texture is significantly suppressed and thus the anisotropy of the mechanical property is mitigated.

A conditioning or regulation of the cast strip surface may be carried out before cold-rolling, in accordance with need. The surface conditioning is carried out for eliminating defects or roughness present on the cast strip surface to a degree at which cold-rolling can be carried out without substantial problems. Such surface conditioning may be effected by grinding, shot-blasting, particle-spraying with a pressurized water, brushing, light-reduction rolling, or pickling with an acid solution having a dissolution rate not significantly varying with the chromium content of the cast strip steel. A cast strip may be annealed before cold-rolling.

The present inventive process enables roping to be eliminated by skin pass rolling.

When pickling is not carried out before cold-rolling or when pickling is carried out with an acid solution having a dissolution rate not significantly varying with the chromium content of the strip to be rolled, the grain boundary corrosion due to the pickling and the resulting nonuniform luster do not occur, and therefore, the cooling rate during cooling of a cast strip from the casting temperature or cooling during any annealing is not limited.

When pickling is carried out for descaling prior to cold-rolling, a cast strip is cooled at a cooling rate of at least 10° C./sec in the temperature range of from 900° to 550° C., as specified in claim 2. A pre-treatment before pickling may be carried out by the aforementioned surface conditioning such as shot-blasting, or particle-spraying with a pressurized water, etc. The cooling rate is limited to prevent the grain boundary precipitation of chromium carbides, which cause the grain boundary corrosion during pickling. The thus suppressed grain boundary precipitation also has an advantage in the prevention of a nonuniform luster, for the following reason.

The pickling for descaling of an austenitic stainless steel before cold-rolling is usually carried out by using a mixed nitric and fluoric acid which has a dissolution rate significantly varying in accordance with the chromium content of the steel, and the grain boundary corrosion easily occurs if the grain boundary precipitation of chromium carbides has occurred during cooling in the casting or the annealing step. During cold-rolling of a cast strip, a nonuniform luster is caused by any grain boundary corrosion. The specified cooling from the casting temperature thus suppresses such grain boundary precipitation, and the resulting nonuniform luster on the cold-rolled strip surface.

When it is desired to make the amount of $\delta$-ferrite retained in a cast strip as small as possible, an annealing is additionally effected at a temperature of 1050° C. or higher, prior to the above-described cooling followed by pickling, as specified in claim 3. A pretreatment before pickling also may be carried out in a manner as described above. The δ-ferrite amount is reduced by annealing after cold-rolling, but should be preliminarily lowered in the state of a cast strip, since it adversely affects the formability and the corrosion resistance of a product strip or sheet.

EXAMPLES

Thin strips or sheets are produced from the six austenitic stainless steels having the compositions shown in Table 1, through casting using an internally water-cooled, twin-roll type vertical continuous caster and cold-rolling. Table 2 shows the surface appearance and the mechanical property of the thin strip or sheet products obtained by varying the cast strand thickness, the casting condition, the cold-rolling condition, and the skin pass rolling condition. In Table 2, the roping height is expressed in terms of the wave height measured by a roughness meter and the nonuniform luster was judged by a visual observation. The in-plane anisotropy of mechanical property is expressed by the value ΔEl defined by the following equation:

$$\Delta El = (El_L + EL_C - 2El_{45})/2,$$

where $EL_L$, $EL_C$, and $El_{45}$ represent the elongations (%) in the rolling direction, in the direction perpendicular to the rolling direction, and in the direction inclined at an angle of 45 degrees to the rolling direction, respectively.

In the samples 1 to 6 according to the present invention, roping which had occurred during cold-rolling was eliminated by skin pass rolling. Roping having a height not exceeding 0.2 μm is not judged to be roping, as it causes no problem with the product. The samples 1 to 6 also have a good surface luster, i.e., a nonuniform luster was not observed. These samples also have a practically acceptable mechanical property and an in-plane anisotropy remarkably smaller than that of the samples 13 and 14 obtained through a conventional process.

In the comparative samples 7 and 8, roping was not eliminated because the elongation in skin pass rolling was less than the specified lower limit of 0.5%. In the comparative samples 9 and 10, which had been skin pass-rolled at an elongation exceeding the specified upper limit of 2.5%, roping was eliminated but the 0.2% proof stress was excessive and the elongation of the product strip or sheet was poor, and a practically required mechanical property was not obtained. In the samples 9 to 12 produced under an insufficiently slow cooling rate in the temperature range of from 900 to 550° C., a nonuniform luster was exhibited due to the grain boundary corrosion during pickling with a mixed nitric and fluoric acid solution.

The conventional samples 13 and 14, which were produced by hot-rolling a 150 mm thick slab to a 4.5 mm thick hot strip and by the subsequent steps shown in Table 2, exhibited no roping or nonuniform luster but had a greater in-plane anisotropy of the mechanical properties than the present inventive samples 1 to 6.

The present inventive process for producing a strip or sheet of an austenitic stainless steel, in which a cast strip having a thickness close to that of a product strip or sheet is continuous-cast and the cast strip is cold-rolled, solves the surface appearance problem due to a decreased total rolling reduction, and thus enables a hot-strip mill to be omitted to thereby reduce the process steps and the energy consumption otherwise required therefor.

The present inventive process has another advantage in that, because the lower total rolling draft prevents the development of a rolled texture, an earing occurring during deep drawing can be significantly suppressed.

TABLE 1

| Steel Symbol | Chemical Composition (wt %) | | | | | | | | | | | | |
|---|---|---|---|---|---|---|---|---|---|---|---|---|---|
| | C | Si | Mn | P | S | Ni | Cr | Mo | Cu | Al | O | N | Others |
| A | 0.050 | 0.59 | 1.21 | 0.029 | 0.004 | 8.90 | 18.8 | 0.09 | 0.20 | 0.007 | 0.0041 | 0.061 | |
| B | 0.029 | 0.75 | 1.84 | 0.031 | 0.006 | 9.10 | 18.7 | 0.10 | 0.04 | 0.039 | 0.0034 | 0.039 | |
| C | 0.051 | 0.71 | 0.88 | 0.025 | 0.006 | 10.15 | 18.1 | 2.01 | 0.01 | 0.029 | 0.0053 | 0.039 | |
| D | 0.035 | 0.70 | 0.84 | 0.025 | 0.004 | 10.30 | 18.3 | 0.11 | 0.21 | 0.004 | 0.0047 | 0.041 | Ti 0.31 |
| E | 0.050 | 0.54 | 0.82 | 0.030 | 0.005 | 10.40 | 18.5 | 0.06 | 0.02 | 0.011 | 0.0052 | 0.049 | Nb 0.60 |
| F | 0.045 | 1.20 | 0.88 | 0.024 | 0.002 | 20.55 | 25.4 | 0.09 | 0.08 | 0.017 | 0.0020 | 0.051 | |

TABLE 2

| Sample No. | Steel symbol | Thickness of cast strand (mm) | Cooling rate from 900° C. to 550° C. (°C./sec) | Annealing temp. and time & cooling rate* | Surface conditioning** before cold-rolling | Reduction of cold-rolling (%) | Condition of final annealing |
|---|---|---|---|---|---|---|---|
| 1 | A | 3.3 | 3-5 | — | Grinding | 50 | 1100° C. × 30 sec |
| | | | | | | 85 | 1080° C. × 30 sec |
| 2 | C | 4.5 | 3-5 | — | Grinding | 50 | 1180° C. × 30 sec |
| | | | | | | 85 | 1100° C. × 30 sec |
| 3 | B | 2.5 | 10-30 | — | NID + | 50 | 1100° C. × 30 sec |
| | | | | | Pickling | 85 | 1080° C. × 30 sec |
| 4 | F | 3.0 | 15-45 | — | SB + | 50 | 1150° C. × 30 sec |
| | | | | | Pickling | 85 | 1100° C. × 30 sec |
| 5 | D | 2.8 | 3-5 | 1100° C. × 30 sec | NID + | 50 | 1130° C. × 30 sec |
| | | | | 10-30° C./sec. | Pickling | 85 | 1080° C. × 30 sec |
| 6 | E | 5.6 | 2-3 | 1100° C. × 30 sec | SB + | 50 | 1180° C. × 30 sec |
| | | | | 10-30° C./sec. | Pickling | 85 | 1100° C. × 30 sec |
| 7 | A | 3.3 | 3-5 | — | Grinding | 50 | 1100° C. × 30 sec |
| | | | | | | 85 | 1080° C. × 30 sec |
| 8 | C | 4.5 | 3-5 | — | Grinding | 50 | 1180° C. × 30 sec |
| | | | | | | 85 | 1100° C. × 30 sec |

TABLE 2-continued

| | | | | | | | |
|---|---|---|---|---|---|---|---|
| 9 | B | 2.5 | 4-6 | — | NID + | 50 | 1100° C. × 30 sec |
| | | | | | Pickling | 85 | 1080° C. × 30 sec |
| 10 | F | 3.0 | 3-5 | — | SB + | 50 | 1150° C. × 30 sec |
| | | | | | Pickling | 85 | 1100° C. × 30 sec |
| 11 | D | 2.8 | 10-30 | 1100° C. × 30 sec | NID + | 50 | 1130° C. × 30 sec |
| | | | | 3-5° C./sec | Pickling | 85 | 1080° C. × 30 sec |
| 12 | E | 5.6 | 15-35 | 1100° C. × 30 sec | SB + | 50 | 1180° C. × 30 sec |
| | | | | 2-3° C./sec | Pickling | 85 | 1100° C. × 30 sec |
| 13 | Equi-valent to A | 150→4.5 (Hot rolling) | 20-40 | 1100° C. × 30 sec | SB + | 50 | 1100° C. × 30 sec |
| | | | | 20-35° C./sec | Pickling | 85 | 1080° C. × 30 sec |
| 14 | Equi-valent to C | 150→4.5 (Hot rolling) | 20-40 | 1100° C. × 30 sec | SB + | 50 | 1100° C. × 30 sec |
| | | | | 20-35° C./sec | Pickling | 85 | 1080° C. × 30 sec |

| Sample No. | Elongation in skin pass (%) | Surface quality: Roping height rolling (μm) | Surface quality: Nonuniform | In-plane anisotropy of mechanical luster ΔE1 | property |
|---|---|---|---|---|---|
| 1 | 1.2 | 0.15 | Good | −0.9 | Invention |
| | 0.5 | 0.20 | " | −0.4 | |
| 2 | 2.2 | <0.10 | " | −1.7 | |
| | 0.9 | 0.15 | " | −0.7 | |
| 3 | 0.9 | 0.15 | " | −0.6 | |
| | 0.5 | 0.20 | " | −0.3 | |
| 4 | 1.7 | 0.10 | " | −1.2 | |
| | 0.9 | 0.15 | " | −0.6 | |
| 5 | 1.4 | 0.15 | " | −1.1 | |
| | 0.5 | 0.20 | " | −0.4 | |
| 6 | 2.5 | <0.10 | " | −1.7 | |
| | 0.7 | 0.20 | " | −0.6 | |
| 7 | 0.1 | 0.5 | " | −0.4 | Comparative Sample |
| | 0.3 | 0.35 | " | −0.3 | |
| 8 | 0.3 | 0.40 | " | −0.4 | |
| | 0.2 | 0.45 | " | −0.4 | |
| 9 | 2.9 | <0.10 | No good | −2.1 | |
| | 2.7 | <0.10 | " | −2.0 | |
| 10 | 3.0 | <0.10 | " | −2.2 | |
| | 2.6 | <0.10 | " | −1.8 | |
| 11 | 1.4 | 0.15 | " | −1.1 | |
| | 0.5 | 0.20 | " | −0.4 | |
| 12 | 2.5 | <0.10 | " | −1.7 | |
| | 0.7 | 0.20 | " | −0.6 | |
| 13 | 0.3 | 0.15 | Good | 3.5 | Conventional sample |
| | 0.3 | 0.10 | " | 3.7 | |
| 14 | 0.4 | 0.10 | " | 3.4 | |
| | 0.4 | 0.15 | " | 3.5 | |

*Cooling rate from 900 to 550° C.
**(1) NID: particle spraying by pressurized water.
(2) Pickling: mixed nitric and fluoric acid solution.
(3) SB: Shot blasting.

We claim:

1. A process for producing a cold-rolled strip or sheet of an austenitic stainless steel, comprising the steps of:

casting a melt of an austenitic stainless steel into a cast strip in the form of a thin strip having a thickness of 10 mm or less by using a continuous caster in which a casting-mold wall is moved synchronously with the cast strip;

cold-rolling the cast strip to form a cold-rolled strip;

final annealing the cold-rolled strip; and skin-pass-rolling the annealed strip at an elongation of from 0.5 to 2.5%.

2. A process according to claim 1 wherein, prior to said cold rolling, said process further comprises cooling said cast strip at a cooling rate of at least 10° C./sec. in a temperature range of from 900° to 550° C. upon casting and then descaling by pickling.

3. A process according to claim 1 wherein, prior to said cold rolling said process further comprises annealing said cast strip at a temperature of 1050° C. or higher and then cooling at a cooling rate of at least 10° C./sec. in a temperature range of from 900° to 550° C.

* * * * *

UNITED STATES PATENT AND TRADEMARK OFFICE

CERTIFICATE OF CORRECTION

PATENT NO. : 5,045,124

DATED : September 3, 1991

INVENTOR(S) : Tpshiyuki SUEHIRO, et al.

It is certified that error appears in the above-identified patent and that said Letters Patent is hereby corrected as shown below:

Column 2, lines 28 and 29, between "of" and "upon casting" insert --from 900 to 550°C.--.

Signed and Sealed this

Twentieth Day of April, 1993

*Attest:*

MICHAEL K. KIRK

*Attesting Officer*

*Acting Commissioner of Patents and Trademarks*